US009687973B2

(12) United States Patent
Jin et al.

(10) Patent No.: US 9,687,973 B2
(45) Date of Patent: Jun. 27, 2017

(54) SCREW RELEASING DEVICE WITH GUIDING FUNCTION

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Chun-Xu Jin, Shenzhen (CN); Zhi-Yu Hu, Shenzhen (CN); Guo-Jun Yang, Shenzhen (CN); Ting-Hui Deng, Shenzhen (CN); Long-Fong Chen, New Taipei (TW); Chung-Yuan Chen, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/837,653

(22) Filed: Aug. 27, 2015

(65) Prior Publication Data

US 2016/0271769 A1 Sep. 22, 2016

(30) Foreign Application Priority Data

Mar. 17, 2015 (CN) ..... 2015 1 0116003

(51) Int. Cl.

| | |
|---|---|
| ***B65G 59/00*** | (2006.01) |
| ***B65H 3/00*** | (2006.01) |
| ***G07F 11/16*** | (2006.01) |
| ***B25B 23/06*** | (2006.01) |

(52) U.S. Cl.

CPC ..... *B25B 23/065* (2013.01)

(58) Field of Classification Search

CPC ..... B25B 23/04; B65D 83/0409; B25F 5/00
USPC ..... 221/151; 81/434
See application file for complete search history.

(56) References Cited

U.S. PATENT DOCUMENTS

| | | | | | |
|---|---|---|---|---|---|
| 2,913,934 | A | * | 11/1959 | Quackenbush | B23Q 5/32 74/841 |
| 2,922,447 | A | * | 1/1960 | Moore | B25B 23/06 81/435 |
| 5,101,697 | A | * | 4/1992 | Fishback | B25B 23/045 81/433 |
| 5,452,630 | A | * | 9/1995 | Haas | B25B 23/045 81/434 |

(Continued)

FOREIGN PATENT DOCUMENTS

| | | | | | |
|---|---|---|---|---|---|
| CH | EP 0623426 | A1 | * | 11/1994 | B25B 23/045 |
| JP | GB 2320905 | A | * | 7/1998 | B25B 21/00 |

*Primary Examiner* — Rakesh Kumar
(74) *Attorney, Agent, or Firm* — Steven Reiss

(57) ABSTRACT

A screw releasing device with a guiding function includes a first housing, a control mechanism, and a guiding hole, the first housing defines a first receiving groove, the control mechanism is received in the first receiving groove, and includes a first cam, a second cam, and a third cam, the third cam includes a serrated member, the guiding hole receives a number of screws, and defines a first opening, when the first cam is not driven, the serrated member extends to the guiding hole via the first opening, so that the serrated member is at a supporting location and supports a bottom-most screw, when the first cam is driven, the first cam drives the third cam to be not limited by the second cam and rotate, thus the serrated member is rotated to release the bottom-most screw.

11 Claims, 8 Drawing Sheets

(56) References Cited

U.S. PATENT DOCUMENTS

| | | | | | |
|---|---|---|---|---|---|
| 5,904,079 | A * | 5/1999 | Tsuge | B25B 23/045 | 81/434 |
| 5,983,032 | A * | 11/1999 | Miyamoto | G02B 7/102 | 396/83 |
| 5,988,025 | A * | 11/1999 | Sasaki | B25B 23/045 | 81/434 |
| 6,267,639 | B1 * | 7/2001 | Menow | A63H 5/00 | 221/152 |
| 6,296,166 | B1 * | 10/2001 | Huang | B25B 23/045 | 227/119 |
| 6,409,045 | B1 * | 6/2002 | Lauer | G07F 11/38 | 221/124 |
| 7,121,174 | B2 * | 10/2006 | Lai | B25B 23/045 | 81/434 |
| 7,293,486 | B2 * | 11/2007 | Chang | B25B 23/045 | 81/434 |
| 7,424,840 | B1 * | 9/2008 | Huang | B25C 5/1627 | 81/435 |
| 8,136,696 | B2 * | 3/2012 | Cheng | B65H 35/10 | 221/151 |
| 2014/0260831 | A1 * | 9/2014 | Hays | B25B 23/0064 | 81/434 |

* cited by examiner

SCREW RELEASING DEVICE WITH GUIDING FUNCTION

CROSS-REFERENCE TO RELATED APPLICATIONS

This application claims priority to Chinese Patent Application No. 201510116003.6 filed on Mar. 17, 2015, the contents of which are incorporated by reference herein.

FIELD

The subject matter herein generally relates to screw mechanisms, and particularly to a screw releasing device with a guiding function.

BACKGROUND

In assembly process of many electronic devices, such as smart phones, and tablet computers, members in antimagnetic interference area of these electronic devices should be fastened with non-magnetic screws. The assembly of electronic devices can use other methods of affixing two parts such as gluing or press fitting. In yet other implementations a single use fastener can be implemented.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
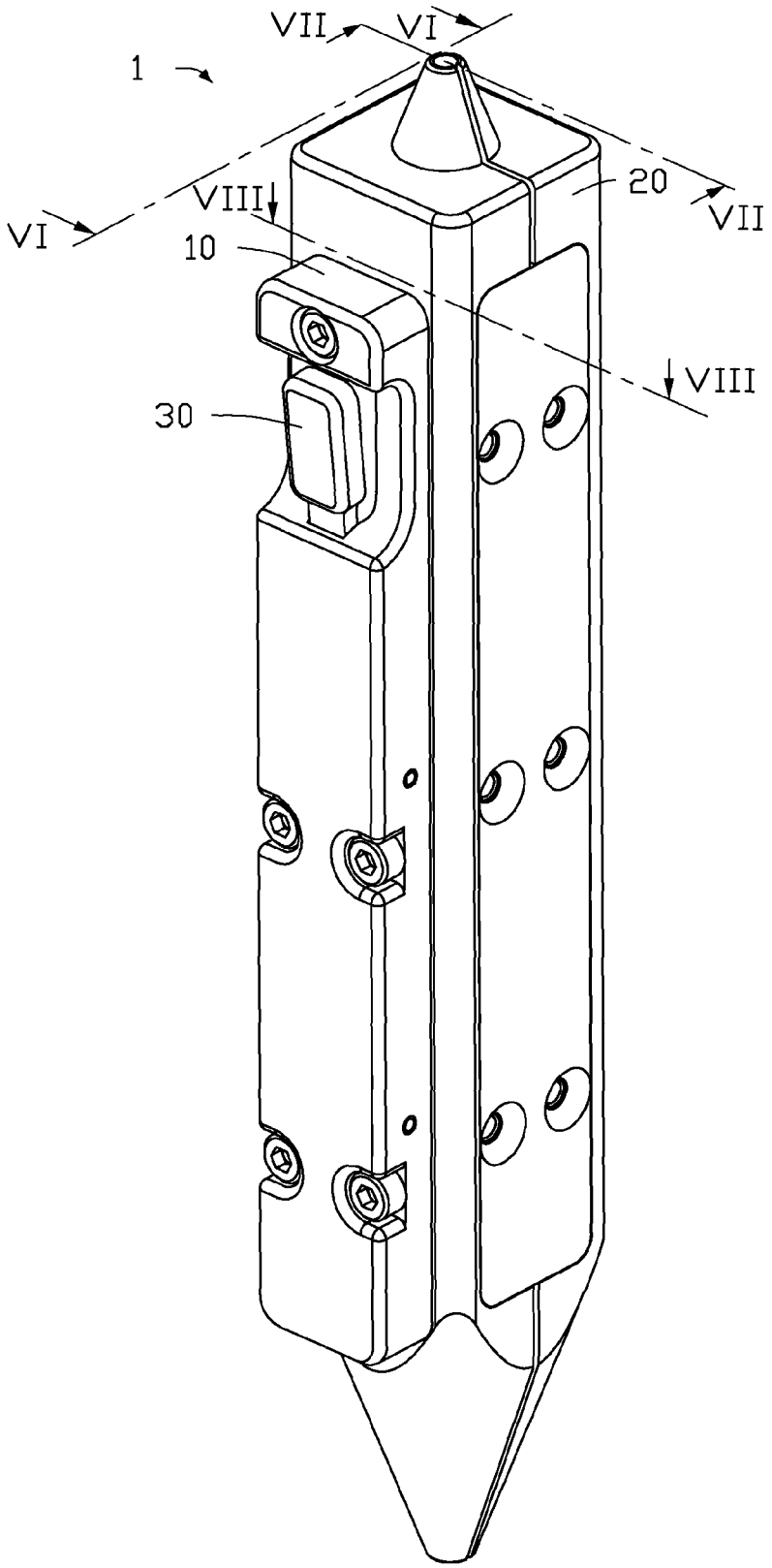
FIG. 1 is an isometric view showing an embodiment of a screw releasing device with a first housing and a second housing.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts can be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series and the like.

Embodiments of the present disclosure will be described with reference to the accompanying drawings.

Figure 2:
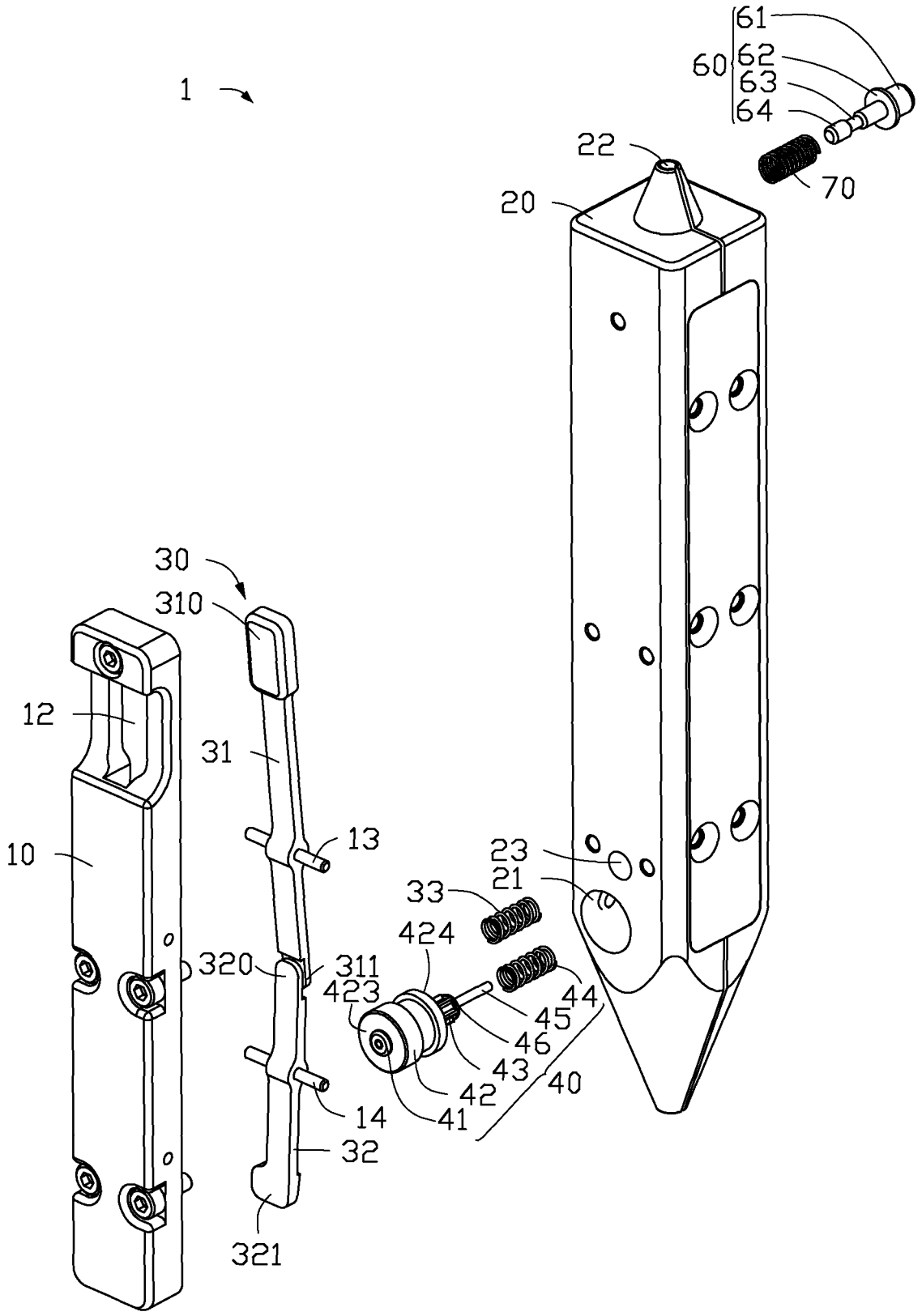
FIG. 2 is an exploded, isometric view of the screw releasing device.

FIG. 1 illustrates an embodiment of a screw releasing device 1. As illustrated in FIG. 2, the screw releasing device 1 includes a first housing 20 and a control mechanism 40. In the illustrated embodiment, the first housing 20 is substantially a square tubular body of which a top and a bottom are conical. The first housing 20 defines a transverse first receiving groove 21 at the bottom of the first housing 20, the first receiving groove 21 receives the control mechanism 40. In the illustrated embodiment, a portion of the bottom of the first receiving groove 21 is open.

Figure 3:
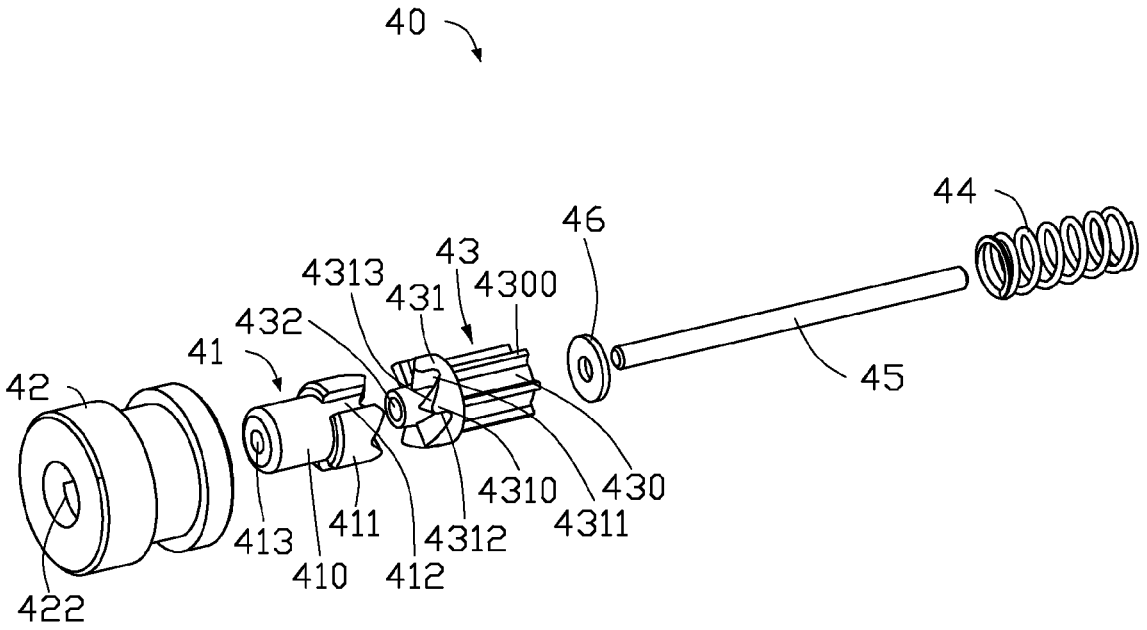
FIG. 3 is an exploded, isometric view of a control mechanism of the screw releasing device.

As shown in FIG. 2, the control mechanism 40 includes a first cam 41, a second cam 42, and a third cam 43. The first cam 41 and the third cam 43 are limited by the second cam 42 and align with each other. The first cam 41 passes through the second cam 42, and a portion of the first cam 41 extends out from the first housing 20 and a side 423 of the second cam 42. As illustrated in FIG. 3, the third cam 43 includes a serrated member 430, a portion of the serrated member 430 extends out from another side 424 of the second cam 42, and the serrated member 430 includes a number of serrations 4300. In the illustrated embodiment, there are six serrations 4300 on the serrated member 430, and the distance between any two adjacent serrations 4300 is the same.

Figure 4:
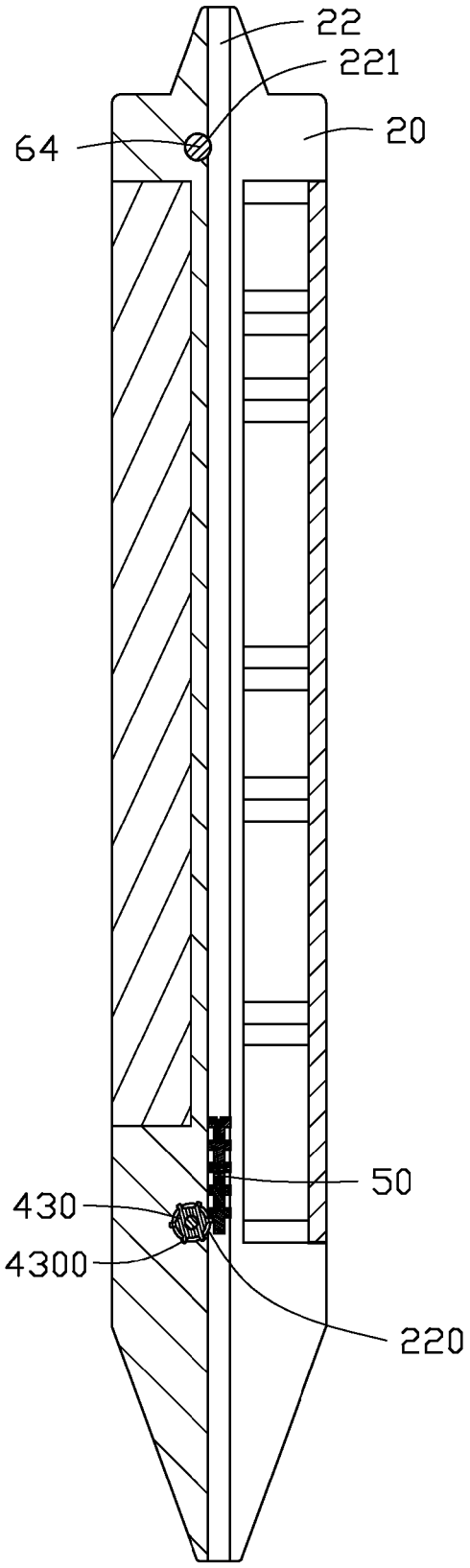
FIG. 4 is a cross-sectional view of the screw releasing device along a line VII-VII of FIG. 1.

As illustrated in FIG. 4, the first housing 20 defines a vertical guiding hole 22 which passes through the first housing 20 from the top to the bottom, and the guiding hole 22 receives a number of screws 50. A sidewall of the guiding hole 22 defines a first opening 220 aligning with the serrated member 430. The serrated member 430 extends to the guiding hole 22 via the first opening 220. When the first cam 41 is not driven, a serration 4300 of the serrated member 430 is at a supporting location, and supports the screws 50 in the guiding hole 22 by holding in place the bottommost of the screws 50.

The first cam 41 of the control mechanism 40 can drive the third cam 43 to move in response to an external force. The first cam 41 can drive the third cam 43 to be unlimited by the second cam 42 and to rotate relative to the second cam 42, thus the serrated member 430 of the third cam 43 is rotated accordingly to release the bottommost of the screws 50, the bottommost screw 50 thereby slides out from the bottom of the first housing 20 along the guiding hole 22.

The release of the bottommost screw 50 and rotation of the serrated member 430 allows the next screw 50 to become the bottommost screw 50, the same moving down until another serration 4300 is rotated to the supporting location. The now-bottommost screw 50 is at the bottom and is supported by the serration 4300 currently at the supporting location. In the illustrated embodiment, each time one screw 50 is slid out, a rotation angle of the third cam 43 is a constant sixty degrees.

Figure 5:
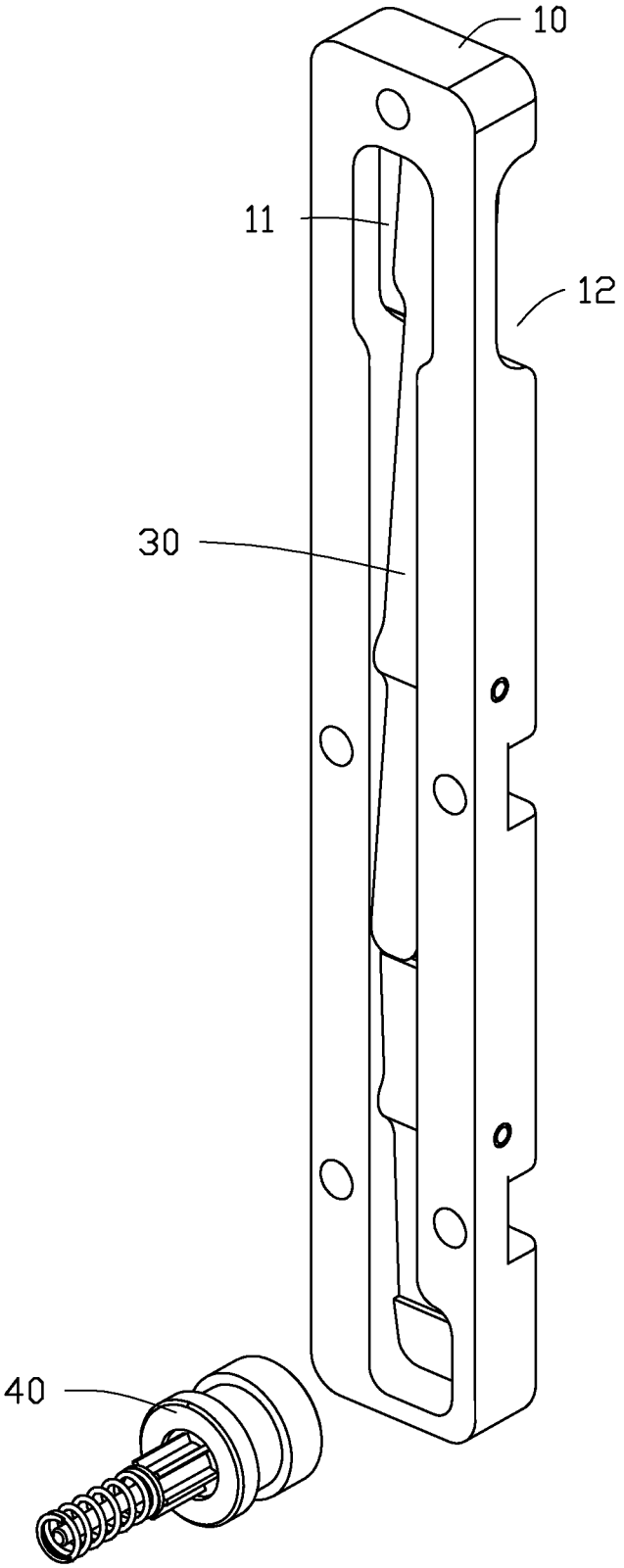
FIG. 5 is an exploded, isometric view of the second housing of the screw releasing device.

As shown in FIG. 2, the screw releasing device 1 further includes a second housing 10 and a driving mechanism 30. The second housing 10 is fixed on a sidewall of the first housing 20, as illustrated in FIG. 5, the second housing 10 defines a second receiving groove 11 and a second opening 12. The second receiving groove 11 receives the driving mechanism 30. A portion of the driving mechanism 30 extends out from the second opening 12. The second cam 42 is fixed on the bottom of the second housing 10, the first cam 41 passes through the second cam 42, and partially extends to the second receiving groove 11, to align with the driving mechanism 30.

The driving mechanism 30 is in contact with the first cam 41, and drives the first cam 41 to push the third cam 43 to be out of the limit of the second cam 42 in response to the external force applied to the driving mechanism 30. The serrated member 430 can thus be rotated to release the bottommost screw 50, the bottommost screw 50 thereby sliding out from the first housing 20 along the guiding hole 22.

Figure 6:
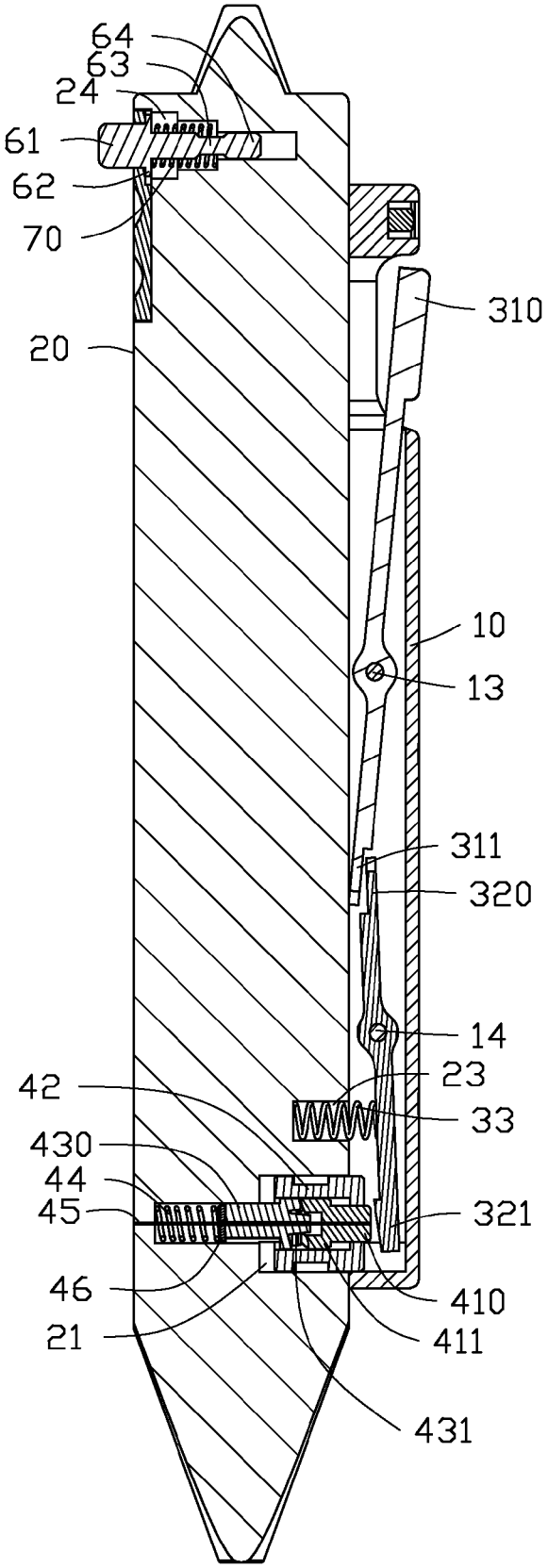
FIG. 6 is a cross-sectional view of the screw releasing device along a line VI-VI of FIG. 1.

As shown in FIG. 2, in detail, the driving mechanism 30 includes a first connection rod 31 and a second connection rod 32. The first connection rod 31 includes a pressing member 310 and a first connection member 311 located at opposite ends of the first connection rod 31, the pressing member 310 extends out from the second opening 12 of the second housing 10. The second connection rod 32 includes a second connection member 320 and a push member 321 located at opposite ends of the second connection rod 32. The second connection member 320 is in contacted with the first connection member 311 and the push member 321 aligns with the first cam 41 which extends to the second receiving groove 11. As illustrated in FIG. 6, the second housing 10 further includes a first rotational shaft 13 and a second rotational shaft 14. The first connection rod 31 is rotatably fixed on the first rotational shaft 13 and can rotate about the first rotational shaft 13, the second connection rod 32 is rotatably fixed on the second rotational shaft 14 and can rotate about the second rotational shaft 14.

Figure 7:
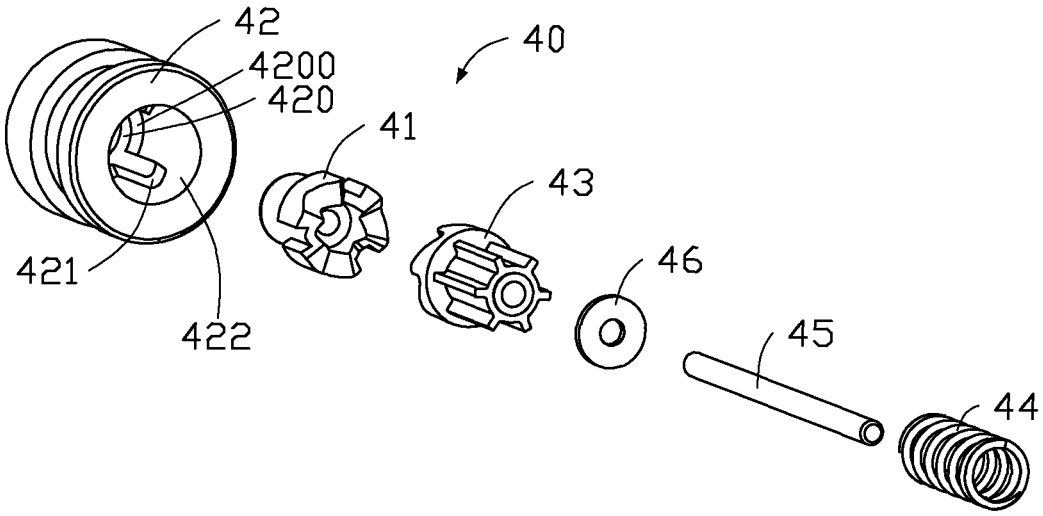
FIG. 7 is another exploded, isometric view of the control mechanism of FIG. 3.

As shown in FIG. 3, the first cam 41 includes a cylinder 410 and a number of serrated blocks 411 which are set in an end of the cylinder 410. A slot 412 is formed between each two serrated blocks 411. In the illustrated embodiment, there are three serrated blocks 411 and three slots 412 on the first cam 41. As illustrated in FIG. 7, the second cam 42 defines an opening 422 in each end, an inner sidewall of the second cam 42 defines a latching ring 420, and a number of latching bars 421 which extend perpendicularly from a surface 4200 of the latching ring 420. In the illustrated embodiment, the number of the latching bars 421 is the same as the number of slots 412, such as, the number of latching bars 421 and the number of slots 412 both are three.

The first cam 41 is inserted into the second cam 42 from the end which defines the latching bars 421 of the second cam 42. The serrated blocks 411 resist the latching ring 420 and the slots 412 are fitted with the latching bars 421. The first cam 41 is thereby fixed non-rotatably in the second cam 42, and the first cam 41 can move along the latching bars 421 when driven by the driving mechanism 30. An end of the cylinder 410 without the serrated blocks 411 extends out from the second cam 42 and aligns with the push member 321 of the second connection rod 32.

The third cam 43 further includes a serrated block 431 which is connected with the serrated member 430. The serrated block 431 includes a number of protrusion members 4310 and a number of recess members 4311. The protrusion members 4310 extend along a direction parallel with the latching bars 421 and each protrusion member 4310 is a protrusion with substantially a right triangle cross section. Each protrusion member 4310 includes a horizontal surface 4312 and a slope surface 4313. When the driving mechanism 30 is not driving the first cam 41, a part of the protrusion members 4310 contact the latching bars 421 via the horizontal surface 4312, and the protrusion members 4310 are in contact with the serrated blocks 411 of the first cam 41, the third cam 43 is thereby limited by the second cam 42. In the illustrated embodiment, there are six protrusion members 4310 and six recess members 4311 on the serrated block 431, three protrusion members 4310 are in contact with three latching bars 421.

As shown in FIG. 3, the control mechanism 40 further includes a first spring 44, a fixing rod 45, and a fixing ring 46. The fixing ring 46 wraps the fixing rod 45. The first cam 41 further defines a first through hole 413 which passes through the first cam 41, and the third cam 43 further defines a second through hole 432 which passes through the third cam 43. As shown in FIG. 6, one end of the fixing rod 45 stretches into the first through hole 413 and the second through hole 432, and the other end of the fixing rod 45 is fixed on the bottom of the first receiving groove 21.

The first spring 44 wraps the fixing rod 45, and an initial state of the first spring 44 is being compressed. One end of the first spring 44 contacts the fixing ring 46, and the other end of the first spring 44 contacts the bottom of the first receiving groove 21, the first spring 44 is thereby limited between the fixing ring 46 and the bottom of the first receiving groove 21. The fixing ring 46 is in contact with the serrated member 430 of the third cam 43 by elastic force of the first spring 44 and the third cam 43 is further fixed in the second cam 42 by the elastic force. In the illustrated embodiment, the third cam 43 can rotate about the fixing rod 45 and the first spring 44 can be thereby stretched or compressed.

As shown in FIG. 6, an operating principle of the screw releasing device 1 is described with reference to FIG. 6. When a user needs to install a screw 50 in a screw hole, the user aligns the screw releasing device 1 to the screw hole, and presses the pressing member 310 of the driving mechanism 30. The first connection rod 31 is driven to rotate anticlockwise about the first rotational shaft 13, and the first connection member 311 drives the second connection member 320 to move away from the first housing 20. Accordingly, the second connection rod 32 is driven to rotate clockwise about the second rotational shaft 14, and the push member 321 pushes the first cam 41 to move to the left, thus driving the serrated block 431 to move to the left until the serrated block 431 is out of the limit of the latching bars 421 of the second cam 42.

At the same time, the serrated blocks 411 of the first cam 41 are in contact with the slope surfaces 4313 of the protrusion members 4310, and drive the third cam 43 to rotate until the serrated blocks 411 engage with the recess members 4311 of the serrated block 431.

As shown in FIG. 4, during the rotation of the third cam 43, the serrated member 430 releases the bottom screw 50, and the bottom screw 50 slides out from the first housing 20 along the guiding hole 22 and drops into the screw hole. As the bottommost screw 50 is released, the next screw 50 moves down until another serration 4300 is rotated to the supporting location to support the screw 50 which becomes the new bottommost screw 50. At the same time, each protrusion member 4310 of the serrated block 431 contacts the serrated blocks 411 of the first cam 41 again.

Since the initial state of the first spring 44 is compressed, the first spring 44 is further compressed when the third cam 43 moves left. When the user stops pressing the pressing member 310, the third cam 43 is driven to the right by the elastic restoring force of the first spring 44, until the serrated block 431 is limited by the latching bars 421 of the second cam 42 again. When the driving mechanism 30 drives the first cam 41 again, the serrated block 411 of the first cam 41 is in contact with the protrusion members 4310 of the serrated blocks 431, and drives the third cam 43 to move to the left and be out of the limit of the latching bars 421, and the third cam 43 drives the serrated member 430 to rotate.

As shown in FIG. 2, the driving mechanism 30 further includes a second spring 33. A sidewall of the first housing 20 defines a transverse groove 23 at a location below the second connection rod 32. As shown in FIG. 6, one end of the second spring 33 is fixed on the second connection rod 32, and the other end of the second spring 33 is fixed on the bottom of the groove 23. In the illustrated embodiment, an initial state of the second spring 33 is being compressed. The compressed elastic force of the second spring 33 ensures that until the pressing member 310 is pressed by the user, the second connection rod 32 cannot rotate and the first cam 41 does not move, avoiding a release of the screw 50 by carelessness.

As shown in FIG. 6, the screw releasing device 1 further includes an operating mechanism 60 and a third spring 70. The operating mechanism 60 includes an operating member 61, a limit member 62, an unlocking member 63, and a locking member 64. A sidewall of the first housing 20 defines a transverse third receiving groove 24 at a location closing to the top of the first housing 20 The third receiving groove 24 receives the limit member 62, the unlocking member 63, and the locking member 64, and the operating member 61 extends out from the first housing 20. The limit member 62 limits the operating mechanism 60 in the third receiving groove 24. The third spring 70 is set between the limit member 62 and locking member 64 and wraps a part of the unlocking member 63 One end of the third spring 70 is in contact with the locking member 62, and the other end of the third spring 70 is in contact with the third receiving groove 24.

Figure 8:
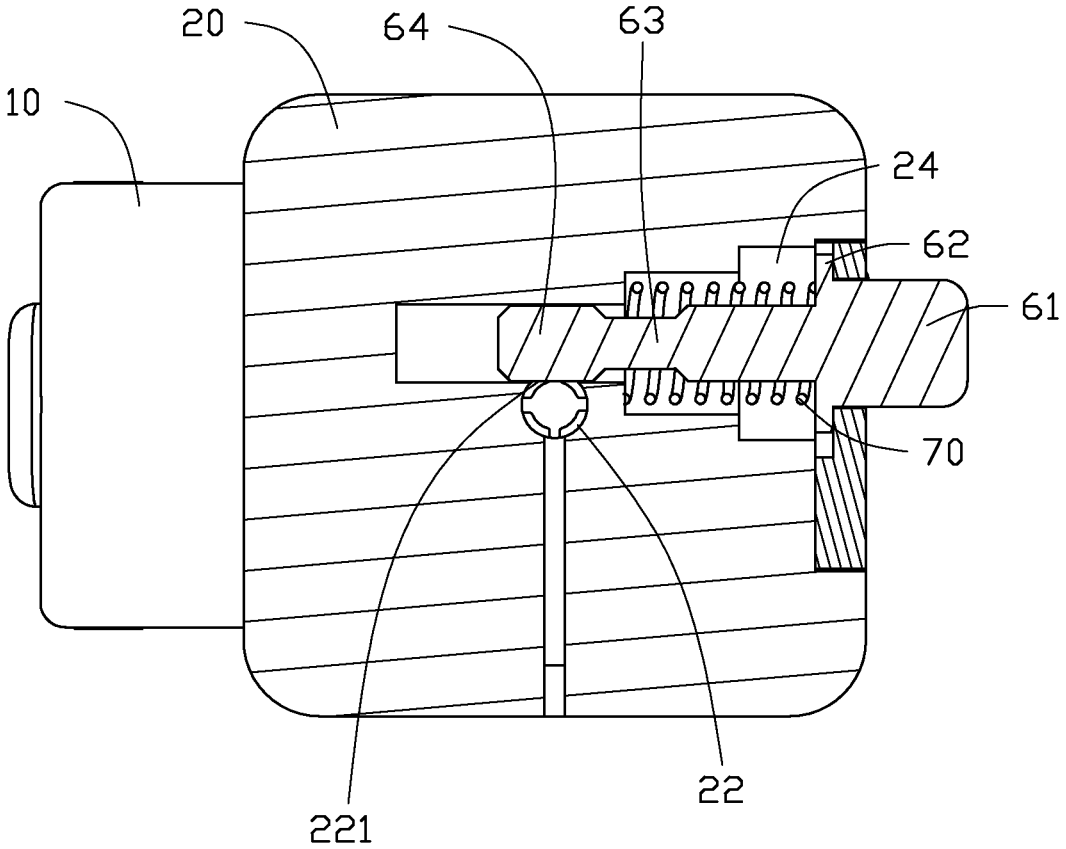
FIG. 8 is a cross-sectional view of the screw releasing device along a line VIII-VIII of FIG. 1.

As illustrated in FIG. 8, the guiding hole 22 defines a third opening 221 at a location corresponding to the third receiving groove 24, the third receiving groove 24 is connected to the guiding hole 22 via the third opening 221. In the illustrated embodiment, the unlocking member 63 and locking member 64 are both cylinders, and a diameter of the locking member 64 is greater than a diameter of the unlocking member 63. If the operating mechanism 60 is not pressed by the user, the third spring 70 is compressed and contains elastic restoring force. The limit member 62 is in contact with the third receiving groove 24 by the elastic restoring force of the third spring 70 and a portion of the locking member 64 extends to the guiding hole 22 via the third opening 221, thereby avoiding the screw 50 sliding out from the top opening of the guiding hole 22.

When the user needs to add the screws 50 into the guiding hole 22, the user can press the operating member 61, the operating member 61 further compresses the third spring 70 and drives the locking member 64 to move to the left until the locking member 64 is in contact with the bottom of the third receiving groove 24, the unlocking member 63 thereby aligns exactly with the third opening 221. The diameter of the unlocking member 63 is relatively small, thus the unlocking member 63 does not extend to the guiding hole 22, the guiding hole 22 is not blocked, and the screws 50 to be added can slide into the guiding hole 22. When further the screws 50 have been added, the user can release the operating member 61, the operating mechanism 60 moves to the right until the limit member 62 is in contact with the third receiving groove 24 again, and the locking member 64 extends to and blocks the guiding hole 22 again.

In other embodiments, the driving mechanism 30 and the second housing 10 can be omitted, and a portion of the first cam 41 of the control mechanism 40 can extend out from the first housing 20. The user can press the first cam 41 directly and drive the first cam 41 to move to the left, and the screw releasing device 1 can execute foregoing process of releasing the screws 50.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A screw releasing device with a guiding function comprising:

a first housing defining a first receiving groove; and a control mechanism received in the first receiving groove, and comprising a first cam, a second cam, and a third cam comprising a serrated member, the first cam and the third cam limited by the second cam, wherein the first cam is configured to pass through the second cam, and a portion of the first cam extends out from the first housing and a side of the second cam;

the first housing defining a guiding hole from a top to a bottom of the first housing, wherein the guiding hole receives a plurality of screws and has a sidewall defining a first opening configured to align with the serrated member;

wherein, when the first cam is not driven, the serrated member extends to the guiding hole via the first opening, so that the serrated member is at a supporting location and supports a bottommost screw, and when the first cam of the control mechanism is driven in response to an external force, the first cam drives the third cam, so that the third cam is not limited by the second cam and rotates relative to the second cam, whereby the serrated member of the third cam is rotated to release the bottommost screw;

wherein the screw releasing device further comprises:

a second housing fixed on a sidewall of the first housing, the second housing defining a second receiving groove and a second opening; and a driving mechanism received in the second receiving groove, and a portion of the driving mechanism extending out from the second opening;

wherein the second cam is fixed on the bottom of the second housing, the first cam passes through the second cam, and partially extends to the second receiving groove, to align with the driving mechanism, the driving mechanism is in contact with the first cam in response to the external force applied to the driving mechanism, and drives the first cam to push the third cam to be out of the limit of the second cam, the serrated member of the third cam is rotated to release the bottommost screw.

2. The screw releasing device according to claim 1, wherein the first cam comprises a plurality of serrated blocks, the third cam further comprises a serrated block, the serrated block of the third cam comprises a plurality of protrusion members and recess members, when the driving mechanism is not driving the first cam, the serrated blocks of the first cam align with the protrusion members of the third cam, when the driving mechanism drives the first cam in response to an external force, the serrated blocks of the first cam are in contact with the serrated block of the third cam, and drive the third cam to rotate until the serrated blocks of the first cam engage with the recess members of the third cam.

3. The screw releasing device according to claim 2, wherein a slot is formed between each two serrated blocks, the second cam defines an opening in each end, an inner side wall of the second cam defines a latching ring, and a plurality of latching bars which extend perpendicularly from the a surface of the latching ring, the plurality of serrated blocks resist the latching ring and the slots are fitted with the latching bars, the first cam is thereby fixed non-rotatably in the second cam, and is capable of moving along the latching bars when driven by the driving mechanism.

4. The screw releasing device according to claim 3, wherein each protrusion member of the third cam comprises a horizontal surface and a slope surface, when the driving mechanism is not driving the first cam, a part of the protrusion members contact to the latching bars via the horizontal surfaces, and the plurality of protrusion members are in contact with the serrated blocks of the first cam, the third cam is thereby limited by the second cam.

5. The screw releasing device according to claim 1, wherein the driving mechanism comprises a first connection rod and a second connection rod, the first connection rod comprises a pressing member and a first connection member located at opposite ends of the first connection rod, the pressing member extends out from the second opening of the second housing, the second connection rod comprises a second connection member and a push member located at opposite ends of the second connection rod, the second connection member is in contact with the first connection member and the push member is aligned with the first cam which extends to the second receiving groove.

6. The screw releasing device according to claim 5, wherein the second housing further comprises a first rotational shaft and a second rotational shaft, the first connection rod is rotatably fixed on the first rotational shaft and is capable of rotating about the first rotational shaft, the second connection rod is rotatably fixed on the second rotational shaft and is capable of rotating about the second rotational shaft.

7. The screw releasing device according to claim 5, wherein the driving mechanism further comprises a second spring, a sidewall of the first housing defines a transverse groove at a location below the second connection rod, one end of the second spring is fixed on the second connection rod, and the other end of the second spring is fixed on the bottom of the groove, an initial state of the second spring is being compressed.

8. A screw releasing device with a guiding function comprising:

a first housing defining a first receiving groove; and a control mechanism received in the first receiving groove, and comprising a first cam, a second cam, and a third cam comprising a serrated member, the first cam and the third cam limited by the second cam, wherein the first cam is configured to pass through the second cam, and a portion of the first cam extends out from the first housing and a side of the second cam;

the first housing defining a guiding hole from a top to a bottom of the first housing, wherein the guiding hole receives a plurality of screws and has a sidewall defining a first opening configured to align with the serrated member;

wherein, when the first cam is not driven, the serrated member extends to the guiding hole via the first opening, so that the serrated member is at a supporting location and supports a bottommost screw, and when the first cam of the control mechanism is driven in response to an external force, the first cam drives the third cam, so that the third cam is not limited by the second cam and rotates relative to the second cam, whereby the serrated member of the third cam is rotated to release the bottommost screw;

wherein the screw releasing device further comprises:

a second housing fixed on a sidewall of the first housing, the second housing defining a second receiving groove and a second opening; and a driving mechanism received in the second receiving groove, and a portion of the driving mechanism extending out from the second opening;

wherein the control mechanism further comprises:

a fixing rod;

a fixing ring wrapping the fixing rod; and a first spring wrapping the fixing rod, wherein an initial state of the first spring is being compressed, one end of the first spring contacts the fixing ring, and the other end of the first spring contacts the bottom of the first receiving groove;

wherein the first cam further defines a first through hole which passes through the first cam and the third cam further defines a second through hole which passes through the third cam, one end of the fixing rod stretches into the first through hole and the second through hole, and the other end of the fixing rod is fixed on the bottom of the first receiving groove, the fixing ring is in contact with the serrated member of the third cam by elastic force of the first spring and the third cam is further fixed in the second cam by the elastic force.

9. A screw releasing device with a guiding function comprising:

a first housing defining a first receiving groove; and a control mechanism received in the first receiving groove, and comprising a first cam, a second cam, and a third cam comprising a serrated member, the first cam and the third cam limited by the second cam, wherein the first cam is configured to pass through the second cam, and a portion of the first cam extends out from the first housing and a side of the second cam;

the first housing defining a guiding hole from a top to a bottom of the first housing, wherein the guiding hole receives a plurality of screws and has a sidewall defining a first opening configured to align with the serrated member;

wherein, when the first cam is not driven, the serrated member extends to the guiding hole via the first opening, so that the serrated member is at a supporting location and supports a bottommost screw, and when the first cam of the control mechanism is driven in response to an external force, the first cam drives the third cam, so that the third cam is not limited by the second cam and rotates relative to the second cam, whereby the serrated member of the third cam is rotated to release the bottommost screw;

wherein the screw releasing device further comprises:

a second housing fixed on a sidewall of the first housing, the second housing defining a second receiving groove and a second opening; and a driving mechanism received in the second receiving groove, and a portion of the driving mechanism extending out from the second opening;

wherein the screw releasing device further comprises an operating mechanism and a third spring, the operating mechanism comprises an operating member, a limit member, an unlocking member, and a locking member, a sidewall of the first housing defines a transverse third receiving groove at a location closest to the top of the first housing, the third receiving groove receives the limit member, the unlocking member, and the locking member, and the operating member extends out from the first housing, the limit member limits the operating mechanism in the third receiving groove, the third spring is set between the limit member and locking member, one end of the third spring is in contact with the locking member, and the other end of the third spring is in contact with the third receiving groove.

10. The screw releasing device according to claim 9, wherein the top and the bottom of the first housing are conical.

11. The screw releasing device according to claim 9, wherein the guiding hole defines a third opening at a location corresponding to the third receiving groove, the third receiving groove is connected to the guiding hole via the third opening, the unlocking member and locking member are both cylinders, and a diameter of the locking member is greater than a diameter of the unlocking member, if the operating mechanism is not pressed, a portion of the locking member extends to the guiding hole via the third opening, if the operating mechanism is pressed, the locking member is driven to move until the locking member is in contact with the bottom of the third receiving groove, the unlocking member aligns exactly with the third opening, and does not extend to the guiding hole.

* * * * *